US006083046A

United States Patent [19]

Wu et al.

[11] Patent Number: 6,083,046

[45] Date of Patent: Jul. 4, 2000

[54] RECEPTACLE CONNECTOR

[75] Inventors: Kun-Tsan Wu, Tu-Chen; Song-Rong Chiou, Lin-Ko, both of Taiwan

[73] Assignee: Hon Hai Precision Ind. Co., Ltd., Taipei Hsien, Taiwan

[21] Appl. No.: 09/356,483

[22] Filed: Jul. 19, 1999

[30] Foreign Application Priority Data

Dec. 31, 1998 [TW] Taiwan ..... 87222057

[51] Int. Cl.[7] ..... H01R 13/648

[52] U.S. Cl. ..... 439/607

[58] Field of Search ..... 439/607, 101, 439/924.1

[56] References Cited

U.S. PATENT DOCUMENTS

| | | | |
|---|---|---|---|
| Re. 35,508 | 5/1997 | Lemke et al. | 439/101 |
| 4,762,500 | 8/1988 | Dola et al. | 439/101 |
| 4,867,690 | 9/1989 | Thumma | 439/924.1 |
| 5,637,014 | 6/1997 | Sukegawa et al. | 439/607 |
| 5,876,222 | 3/1999 | Gardner et al. | 439/607 |

*Primary Examiner*—Gary F. Paumen
*Assistant Examiner*—Phuong Chi Nguyen
*Attorney, Agent, or Firm*—Wei Te Chung

[57] ABSTRACT

A receptacle connector includes an insulative housing having a bottom face mounted to a circuit board and a front face defining an interior space for receiving a mating plug connector. Grooves are defined in upper and lower inside faces of the interior space for receiving and retaining contact elements that electrically engage with conductive pins of the plug connector. Mounting sections of the contact elements extend beyond the bottom face of the housing for connecting to the circuit board. The mounting sections of the upper side contact elements are surface mounted to the circuit board, while the mounting sections of the lower side contact elements are arranged in two rows and mounted to the circuit board by means of a through hole soldering technique. A shielding member has a top panel and two side panels respectively positioned on and abutting against a top face and two side faces of the housing for enclosing the housing and shielding the contact elements. The shielding member has grounding tabs extending from side panels thereof for being grounded to the circuit board.

1 Claim, 6 Drawing Sheets

RECEPTACLE CONNECTOR

BACKGROUND OF THE INVENTION

1. Field of the Invention

The present invention generally relates to an electrical connector, and in particular to a receptacle connector having excellent electrical shielding properties.

2. The Prior Art

A receptacle connector is mated with a plug connector to electrically connect two separate electrical devices. Examples of receptacle and plug connectors are disclosed in Taiwan Patent Application Nos. 83213703, 84302922, 84106428, 83110446 and 83111290. To protect the connectors from being adversely affected by external electromagnetic interference emitting from adjacent electronic devices, the connectors are provided with shielding members. However, as the speed of data transmission has significantly increased, a more effective shielding member is needed to protect the connectors from external electromagnetic interference (EMI).

Furthermore, the development of fine pitch configurations of connectors increases the number of contacts retained in a connector to an extent that the structure of a circuit board to which the connector is mounted may become unstable if the contacts are soldered to the circuit board through holes defined therein. If the contacts are surface mounted to the circuit board, then the small pitch may result in the formation of short circuits between adjacent contacts.

It is thus desirable to have an electrical connector that overcomes the problems mentioned above.

SUMMARY OF THE INVENTION

Accordingly, an object of the present invention is to provide an electrical connector having excellent electrical shielding properties.

Another object of the present invention is to provide an electrical connector having contacts mounted to a circuit board by means of both through hole and surface mounting techniques.

To achieve the above objects, a receptacle connector in accordance with the present invention comprises an insulative housing having a bottom face mounted to a circuit board and a front face defining an interior space for receiving a mating plug connector. Grooves are defined in upper and lower inside faces of the interior space for receiving and retaining contact elements that electrically engage with conductive pins of the plug connector. Mounting sections of the contact elements extend beyond the bottom face of the housing for connecting to the circuit board. The mounting sections of the upper side contact elements are surface mounted to the circuit board, while the mounting sections of the lower side contact elements are arranged in two rows and mounted to the circuit board by a through hole soldering technique. A shielding member has a top panel and two side panels respectively positioned on and abutting against a top face and two side faces of the housing for enclosing the housing and shielding the contact elements. The shielding member has grounding tabs extending from side panels thereof for being grounded to the circuit board.

BRIEF DESCRIPTION OF THE DRAWINGS

The present invention will be apparent to those skilled in the art by reading the following description of the preferred embodiment thereof, with reference to the accompanying drawings, in which.

DETAILED DESCRIPTION OF THE PREFERRED EMBODIMENT

Figure 1:
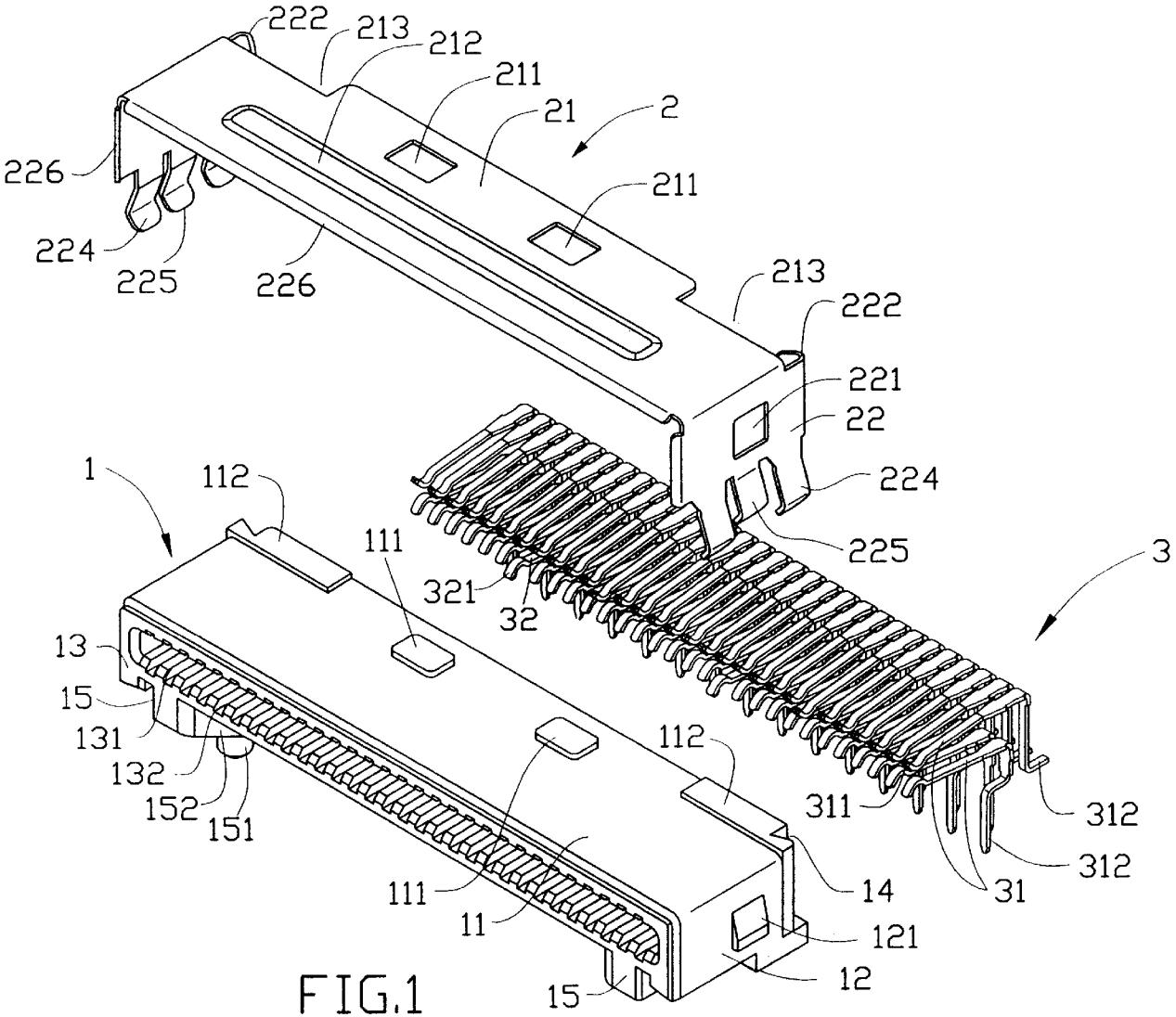
FIG. 1 is an exploded view of a receptacle connector constructed in accordance with the present invention.
Figure 2:
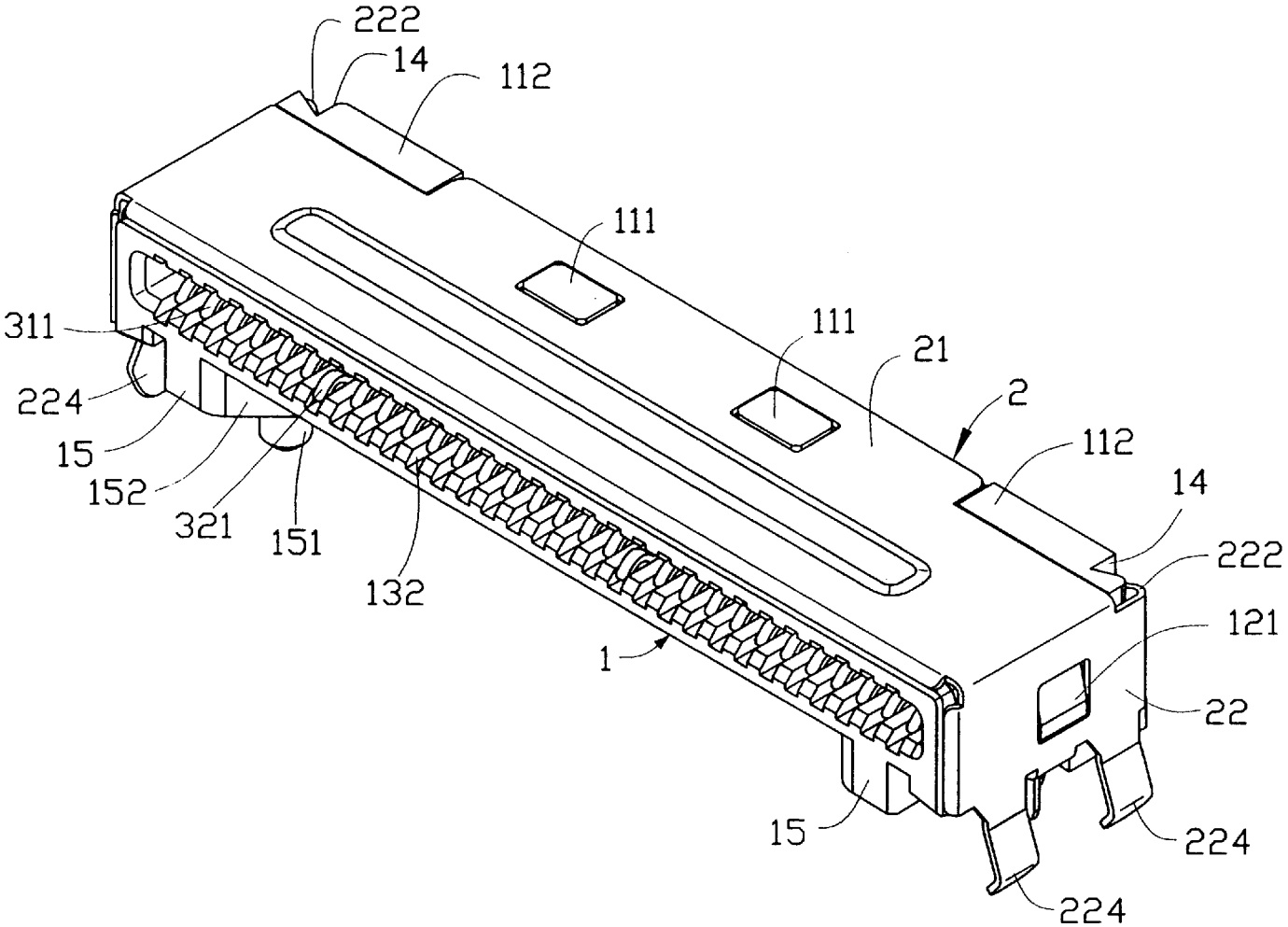
FIG. 2 is an assembled view of FIG. 1.
Figure 4:
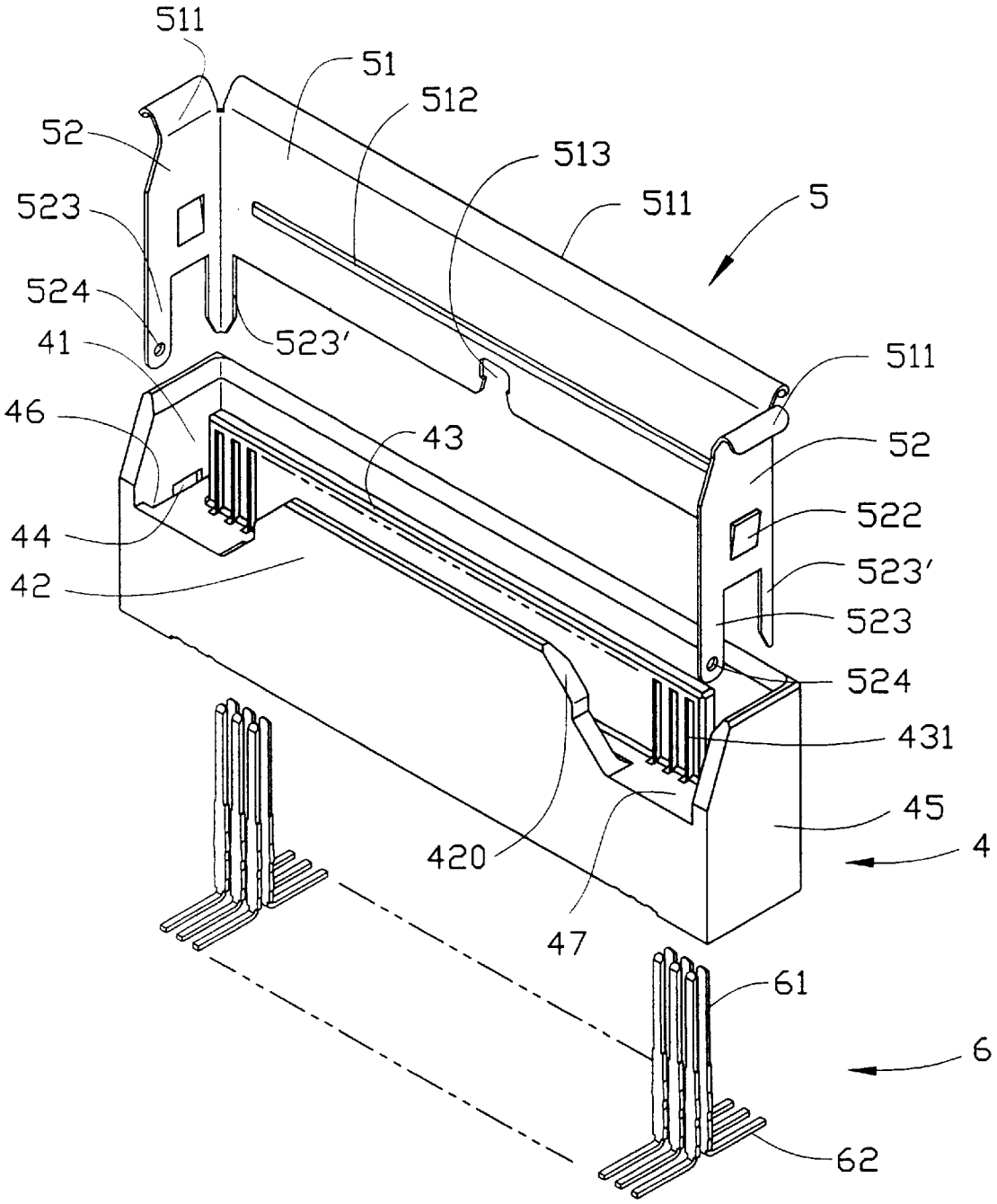
FIG. 4 is an exploded view of a plug connector adapted to mate with the receptacle connector of the present invention.
Figure 5:
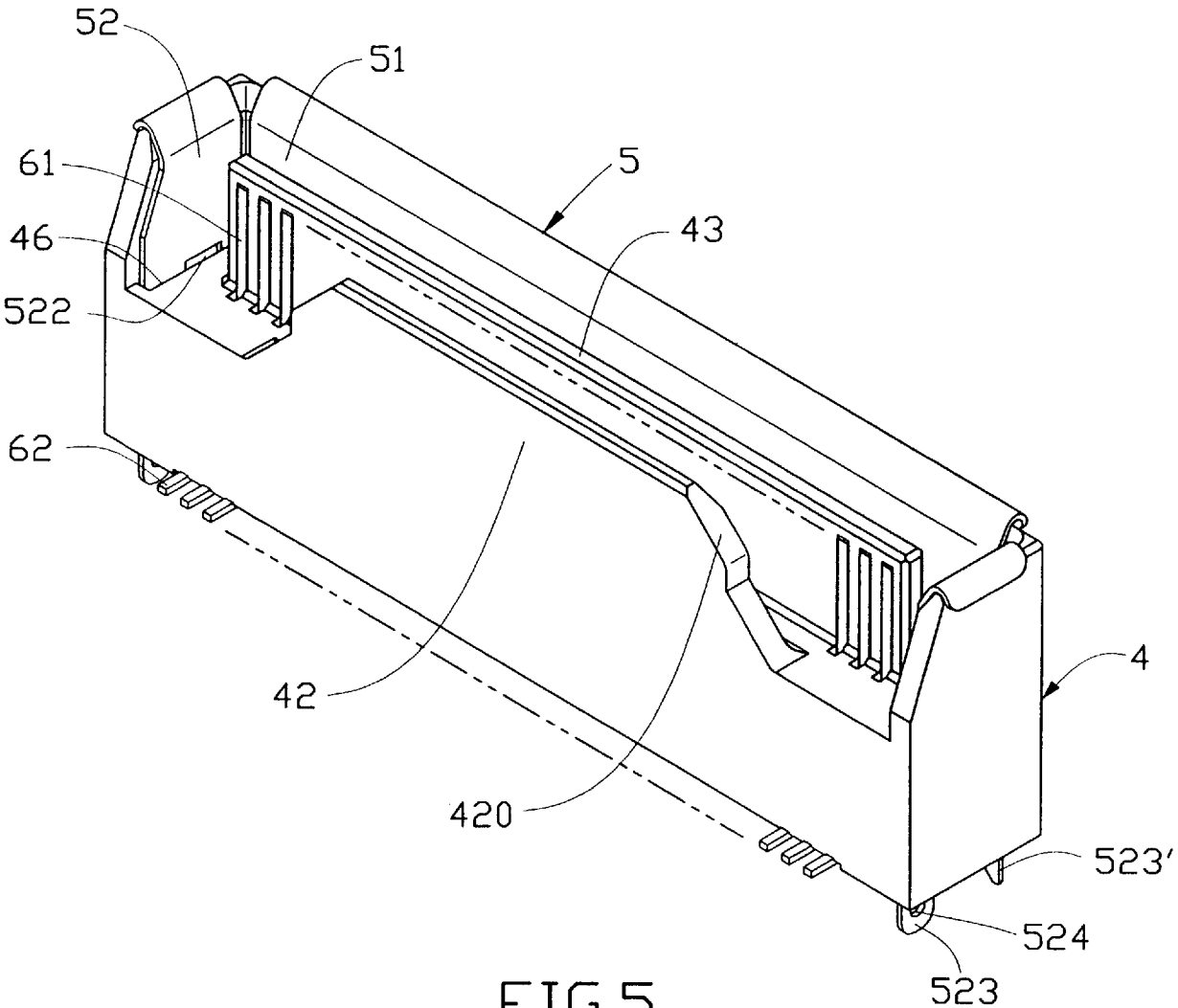
FIG. 5 is an assembled view of FIG. 4.

Referring to the drawings and in particular to FIGS. 1 and 2, a receptacle connector constructed in accordance with the present invention comprises an insulative housing 1 defining an interior space 131 exposed to a front face 13 thereof for receiving a mating plug connector (FIGS. 4 and 5). A plurality of grooves 132 is defined in opposite inside faces of the interior space 131 for receiving and retaining contact elements 3.

A shielding member 2 is mounted to the housing 1. The shielding member 2 comprises a top panel 21 and two side panels 22 extending from opposite ends thereof. The top panel 21 is positioned on a top face 11 of the housing 1. First openings 211 and second openings 213 are defined in the top panel 21 for respectively engaging with first and second projections 111, 112 formed on the top face 11 of the housing 1 thereby properly positioning the shielding member 2 on the housing 1. Each side panel 22 of the shielding member 2 defines a third opening 221 for engaging with a barb 121 formed on a corresponding side face 12 of the housing 1 for fixing the shielding member 2 to the housing 1.

Each side panel 22 forms a fixing tab 225 extending beyond a bottom face (not labeled) of the housing 1 and bent to have a free end thereof inserted into a slit 17 (FIG. 3) defined in the bottom face and extending a predetermined distance from the front face 13 of the housing 1 toward an opposite rear face of the housing 1 thereby securely retaining the shielding member 2 on the housing 1. Grounding tabs 224 extend from each side panel 22 of the shielding member 2 for connecting to a first circuit board (not shown) for electrical grounding purposes. An elongate rib 212 extending parallel to the front face 13 of the housing 1 is embossed is formed on the top panel 21 of the shielding member 2 for enhancing mechanical properties thereof.

The shielding member 2 forms a hook-shaped inward extension 222 on a rear edge of each side panel 22 for engaging with a notch 14 defined in the housing 1. The shielding member 2 also forms an inward flange 226 on a front edge of each panel 21, 22 for engaging with the front face 13 of the housing 1. The rear extensions 222 and the front flanges 226 secure the shielding member 2 to the housing 1.

Figure 3:
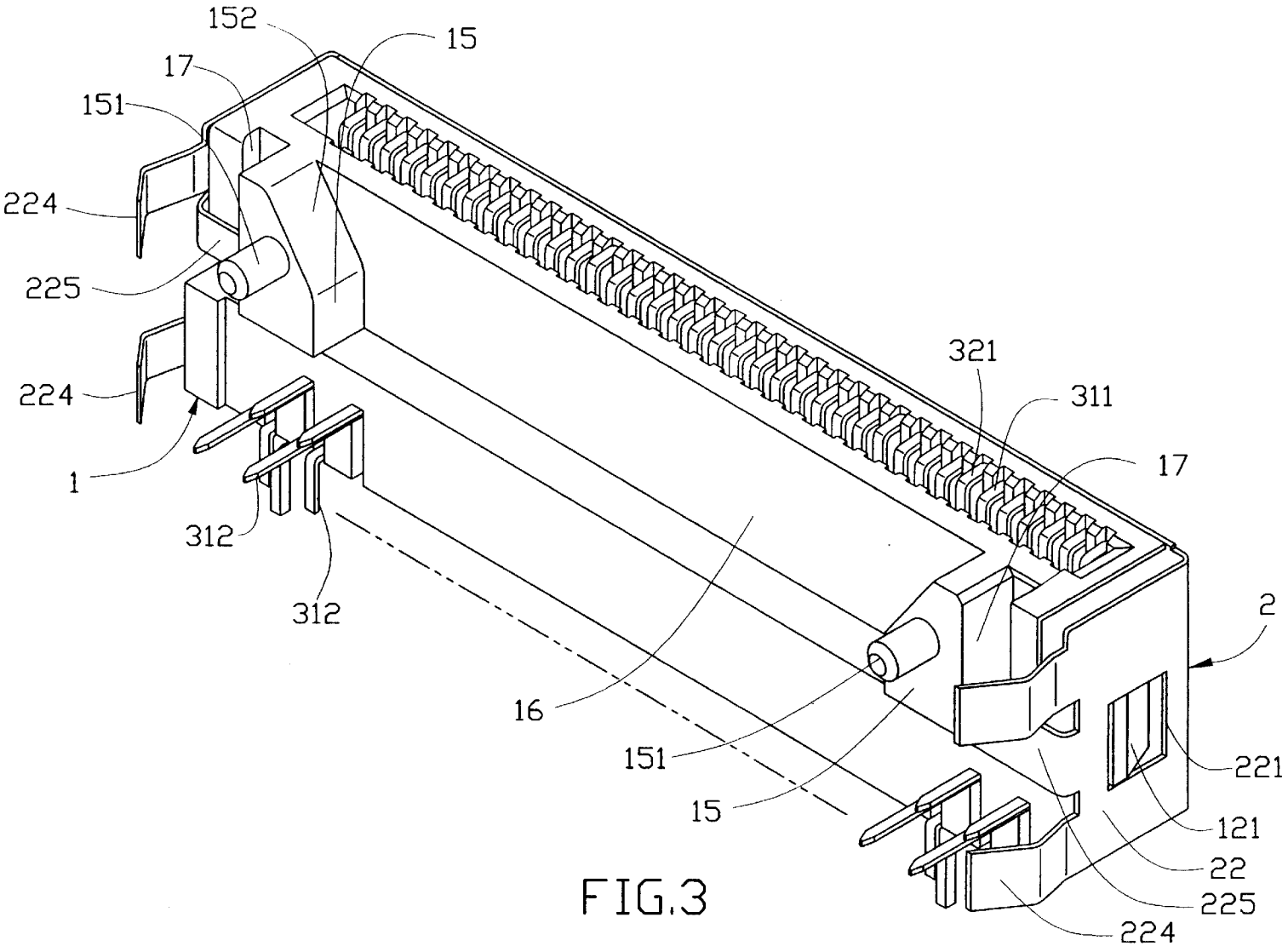
FIG. 3 is similar to FIG. 2, but taken from a different perspective.

Also referring to FIG. 3, two blocks 15 are formed on the bottom face of the housing 1 for stably supporting the housing 1 on the first circuit board. The blocks 15 are spaced from each other thereby defining a passage 16 therebetween. Each block 15 forms an inclined face 152 for guiding a guide plate 42 (FIGS. 4 and 5) of the mating plug connector into the passage 16. A post 151 extends from each block 15 for fitting into a corresponding hole (not show) defined in the first circuit board on which the connector is mounted.

The contact elements 3 include a plurality of signal contacts 31 and four grounding contacts 32. Each contact element 3 has a mating section 311, 321 received and retained in the corresponding groove 132 of the housing 1. In the embodiment illustrated, two grounding contacts 32 are located in each inside face of the interior space 131 of the housing 1 but can be arranged in other ways. Preferably, the mating sections 321 of the grounding contacts 32 are longer than the mating sections 311 of the signal contacts 31 in the direction from the front face 13 of the housing 1 to the opposite rear face of the housing 1 whereby when mating with the plug connector, the grounding contacts 32 engage with corresponding grounding pins of the plug connector before the signal contacts 31 thereby effectively discharging electrostatic charges.

The contact elements 3 have mounting sections 312 extending beyond the bottom face of the housing 1. The mounting sections 312 of the contact elements 3 of an upper inside face of the interior space 131 of the housing 1 are surface mounted to the circuit board, while the mounting sections 312 of the contact elements of a lower inside face of the interior space 131 of the housing 1 are arranged to extend through holes (not shown) formed in the circuit board and are soldered therein. Preferably, the mounting sections 312 of the lower side contact elements 3 are arranged in two rows and staggered with respect to each other. Therefore, the mounting sections 312 of the contact elements 3 are arranged in three rows on the circuit board. Hence, the pitch between adjacent through holes formed in the circuit board is reduced compared to the prior art discussed above thereby improving the mechanical properties of the circuit board.

FIGS. 4 and 5 show an example of the plug connector which is mateable with the receptacle connector of the present invention. The plug connector comprises an insulative housing 4 defining a front cavity 41 bound by three side walls 45 and the guide plate 42 for receiving the receptacle connector of the present invention therein. A tongue plate 43 is formed in the cavity 41 and extends from a bottom face 47 thereof for being snugly inserted into the interior space 131 of the receptacle connector. The tongue plate 43 has opposite faces in which grooves 431 are defined for receiving and retaining mating sections 61 of conductive pins 6 of the plug connector. Mounting sections 62 of the conductive pins 6 extend beyond the housing 4 for being soldered to a second circuit board (not shown). The grooves 431 of the plug connector correspond to the grooves 132 of the receptacle connector thereby allowing the contact elements 3 to contact and electrically engage with the conductive pins 6.

The plug connector further includes a shielding member 5 received in the cavity 41 of the housing 4 and comprising a central panel 51 and two side panels 52 abutting against inside surfaces of the side walls 45 of the housing 4. The panels 51, 52 have outward flanges 511 formed on top edges thereof for engaging with top edges (not labeled) of the side walls 45. The outward flanges 511 contact the inward flanges 226 of the receptacle connector before the contact elements 3 engage with the corresponding conductive pins 6 when the plug connector is inserted into the receptacle plug thereby effecting electrostatic discharge.

A notch 513 is defined in a lower edge of the central panel 51 for engaging with a corresponding projection (not shown) formed in the cavity 41. The notch 513 prevents the central panel 51 from warpage or deformation due to the length thereof. Each side panel 52 forms a barb 522 for engaging with a recess 44 defined in the inside surface of the corresponding side wall 45 for retaining the shielding member 5 in the housing 4. Grounding tabs 523, 523' extend from the panels 51, 52 beyond the housing 4 and through slots 46 defined therein for being connected to the second circuit board for grounding purposes. Preferably, a hole 524 is defined in each tab 523 for soldering enhancement. An elongate rib 512 is formed on the central panel 51 for engaging with the rib 212 of the receptacle connector to securely retain the plug connector in the receptacle connector.

Figure 6:
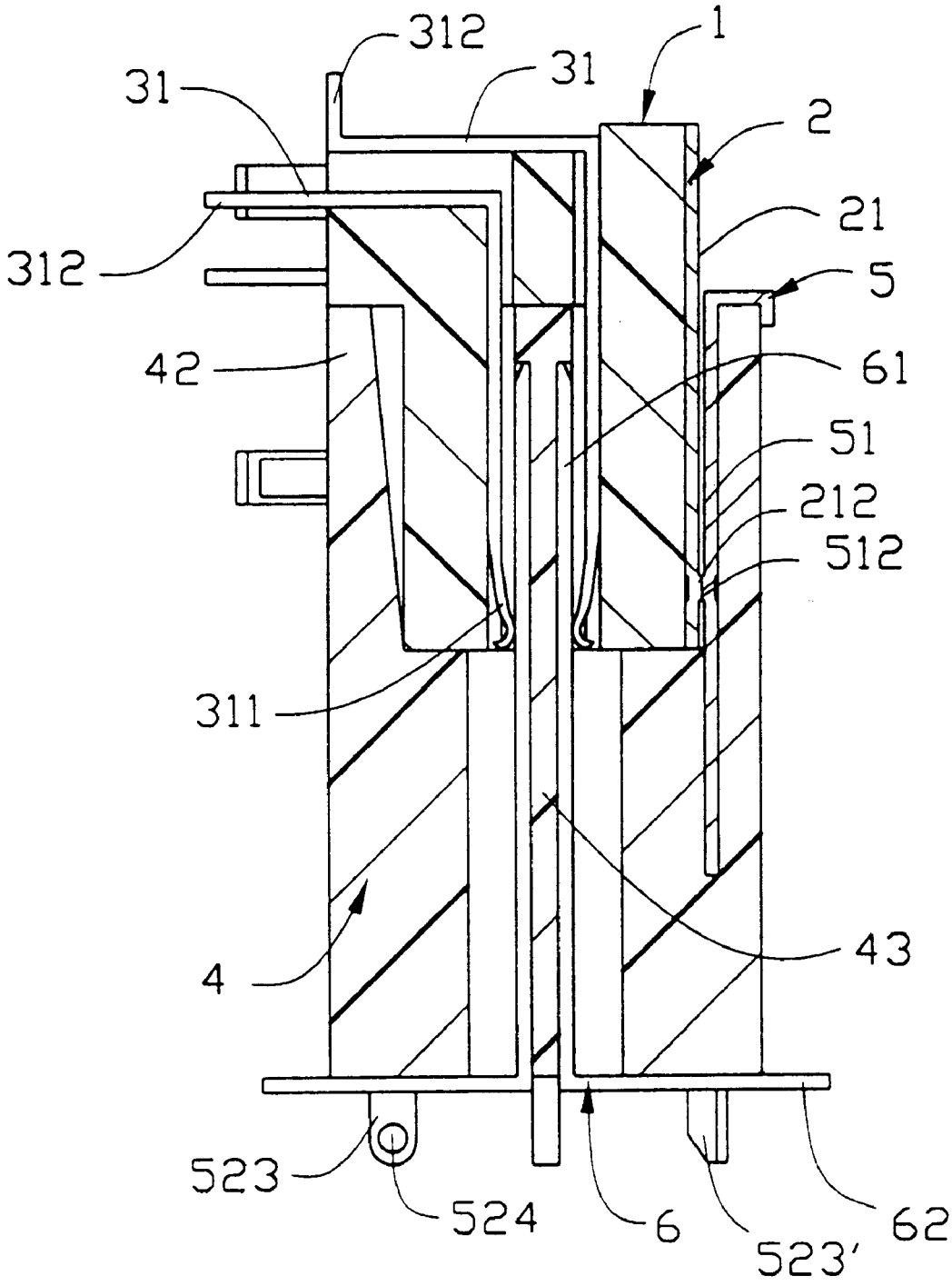
FIG. 6 is a cross-sectional view showing the plug connector mated with the receptacle connector of the present invention.

FIG. 6 shows the plug connector received in the receptacle connector. The mating sections 61 of the conductive pins 6 and the tongue plate 43 are fit into the interior space 131 of the receptacle connector whereby the contact elements 3 located in the inside faces of the interior space 131 interpose the tongue plate 43 therebetween and electrically engage with the corresponding conductive pins 6. The rib 212 of the receptacle connector engages the rib 512 of the plug connector thereby retaining the connectors together. The guide plate 42 of the plug connector is received in the passage 16 between the blocks 15 of the receptacle connector. The guide plate 42 has inclined edges 420 guidingly engaging with the inclined faces 152 of the blocks 15 for guiding the engagement between the connectors and properly positioning the connectors with respect to each other.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A receptacle connector comprising:

an insulative housing having a bottom face adapted to be mounted to a circuit board and a front face defining an interior space therein adapted to receive a mating plug connector, grooves being defined in opposite inside faces of the interior space, the housing defining a pair of notches spaced from each other in a rear face thereof opposite to the front face;

contact elements received and retained in the grooves of the housing for electrically engaging with conductive pins of the plug connector, each contact element having a mounting section extending beyond the bottom face of the housing for being connected to the circuit board; and a shielding member comprising a top panel and two side panels extending from opposite ends of the top panel for being respectively positioned on and abutting against a top face and two side faces of the housing for enclosing the housing and shielding the contact elements, the shielding member having grounding tabs extending therefrom for being grounded to the circuit board, a hook-shaped inward extension extending from a rear edge of each side panel of the shielding member for being received in the pair of notches defined in the housing and an inward flange being formed on each of the top and side panels of the shielding member for bearing against the front face of the housing, thereby securing the shielding member to the housing;

wherein the mounting sections of the contact elements retained in the grooves defined in a first inside face of the interior space are surface mounted to the circuit board, while the mounting sections of the contact elements retained in the grooves defined in an opposite second inside face of the interior space extend through holes defined in the circuit board and are soldered therein;

wherein the mounting sections of the contact elements that extend through the holes of the circuit board are arranged in two rows which are staggered with respect to each other;

wherein the contact elements comprise at least one grounding contact having a length greater than the remaining contact elements for engaging with the corresponding grounding pin of the plug connectors before the remaining contact elements engage with the corresponding conductive pins;

wherein the housing defines a slit in the bottom face thereof adjacent to each side face, said slit extending a predetermined distance from the front face of the housing toward an opposite rear face of the housing, and wherein each side panel of the shielding member comprises a fixing tab extending therefrom for being bent to fit into the corresponding slit thereby retaining the shielding member on the housing;

wherein projections are formed on the top face of the housing for engaging with first openings defined in the top panel of the shielding member thereby properly positioning the shielding member with respect to the housing, wherein a barb is formed on each side face of the housing, and wherein a third opening is defined in each panel of the shielding member for engaging with the corresponding barb to secure the shielding member to the housing;

wherein an elongate rib parallel to the front face of the housing is embossed on the top panel of the shielding member and adapted to engage with a corresponding rib formed in the plug connector for retaining the plug connector in the receptacle connector;

wherein two blocks are formed on the bottom face of the housing for supporting the housing on the circuit board, each block having a post extending therefrom for being inserted into the circuit board to properly position the housing with respect to the circuit board, said block and said post being integrally formed;

wherein two blocks are formed on the bottom face of the housing and define a passage therebetween adapted to receive a corresponding portion of the plug connector therein for properly positioning the plug connector with respect to the receptacle connector;

wherein each block forms an inclined face for guidingly engaging with an inclined edge of the portion of the plug connector.

* * * * *